US009951789B2

(12) United States Patent
Sawyer

(10) Patent No.: US 9,951,789 B2
(45) Date of Patent: Apr. 24, 2018

(54) BLOWER ASSEMBLY FOR A VEHICLE

(71) Applicant: FORD GLOBAL TECHNOLOGIES, LLC, Dearborn, MI (US)

(72) Inventor: Robert Steven Sawyer, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 600 days.

(21) Appl. No.: 14/600,637

(22) Filed: Jan. 20, 2015

(65) Prior Publication Data

US 2016/0208817 A1 Jul. 21, 2016

(51) Int. Cl.

| | |
|---|---|
| ***F04D 29/46*** | (2006.01) |
| ***F04D 17/16*** | (2006.01) |
| ***F04D 27/00*** | (2006.01) |
| ***F04D 29/42*** | (2006.01) |

(52) U.S. Cl.

CPC ..... *F04D 29/464* (2013.01); *F04D 17/16* (2013.01); *F04D 27/002* (2013.01); *F04D 29/4226* (2013.01)

(58) Field of Classification Search

CPC .... F04D 27/002; F04D 29/4229; F04D 17/16; F04D 29/4233; F04D 29/442; F04D 29/464

See application file for complete search history.

(56) References Cited

U.S. PATENT DOCUMENTS

| | | | | |
|---|---|---|---|---|
| 1,056,813 A | | 3/1913 | Mclean | |
| 3,611,724 A | * | 10/1971 | Kutney | F02C 7/042 137/15.1 |
| 4,917,572 A | | 4/1990 | Van Houten | |
| 6,821,088 B2 | | 11/2004 | Sakai et al. | |
| 7,163,456 B2 | | 1/2007 | Miyata | |
| 8,591,183 B2 | * | 11/2013 | Lyons | F04D 29/4226 415/206 |

(Continued)

FOREIGN PATENT DOCUMENTS

| | | |
|---|---|---|
| JP | 2002192934 A | 7/2002 |
| JP | 2003042097 A | 2/2003 |
| JP | 2008208798 A | 9/2008 |

OTHER PUBLICATIONS

English machine translation of the description for JP2003042097.
English machine translation of the description for JP2008208798.
English machine translation of the description for JP2002192934.

*Primary Examiner* — Woody Lee, Jr.
*Assistant Examiner* — Maxime Adjagbe
(74) *Attorney, Agent, or Firm* — Vichit Chea; King & Schicki, LLC

(57) ABSTRACT

A blower assembly includes a housing having a scrolled wall, a motor having an output shaft extending within the housing, an impeller positioned within the housing and mounted to the output shaft for creating an airflow along an airflow path within the housing, an airflow outlet, and a scroll cut-off. The scroll cut-off is a membrane positioned between the scrolled wall and the air flow outlet, and forms a substantially continuous surface with the scrolled wall and with the airflow outlet, along the airflow path. In a first position, the membrane is substantially taut and in a second position, the membrane is relaxed. Alternatively, the membrane is inflatable via a valve in fluid communication with the membrane.

18 Claims, 3 Drawing Sheets

(56) References Cited

U.S. PATENT DOCUMENTS

| | | | | |
|---|---|---|---|---|
| 2004/0165984 | A1* | 8/2004 | Ochiai | F01D 17/143 415/206 |
| 2009/0193806 | A1 | 8/2009 | Kong et al. | |
| 2013/0243584 | A1* | 9/2013 | Kuo | F04D 25/0613 415/203 |

* cited by examiner

BLOWER ASSEMBLY FOR A VEHICLE

TECHNICAL FIELD

This document relates generally to blower assemblies used in a vehicle, and more specifically to tunable blower assemblies associated with heating, ventilation, and air conditioning (HVAC) systems.

BACKGROUND

Blower assemblies are a common component of vehicle HVAC systems and are designed for maximum efficiency/airflow when operated in commonly known re-circulating and fresh modes. In heater mode within the fresh mode, however, the airflow volume can hinder optimal heating performance within the vehicle by over cooling the engine. As a result, the amount of heated coolant available may not be enough to warm-up the passenger compartment to a desired temperature. Even more, the noise level within the passenger compartment in this mode can reach unsatisfying levels due to the large volume of air moving through typically smaller heat passages and outlets. Accordingly, a need exists for a blower assembly that is tunable or adjustable such that a desired airflow volume can be delivered for all modes of operation including the re-circulating and heater mode combination.

While various solutions to this problem exist, each such solution has its own drawbacks. For example, reducing or restricting the airflow volume in heater mode may be accomplished by reducing the speed of the motor/impeller creating the airflow. In this instance, however, adding such restrictions to control heater airflow volume tends to increase turbulence and noise, vibration, and harshness which are equally untenable.

Alternatively, a maximum voltage applied to the motor/impeller may be clipped or limited thus reducing the maximum airflow volume. While the maximum airflow volume may be appropriately reduced using this approach, a minimum voltage applied to the motor/impeller still results in an airflow volume that is greater than what the occupant wants/needs. The minimum voltage is linked to minimum rotations per minute of the motor, and results in an excessive supply of the heated air available to warm-up the passenger compartment to the desired temperature. Even more, the steps between desired settings of high speed and low speed become compressed to the point that an occupant of the vehicle may be unable to discern any difference between the selected settings.

Another method of tuning the blower assembly such that the desired airflow volume can be delivered for all modes of operation is to adjust the scroll cut-off of the blower assembly. One manner of adjusting the scroll cut-off of a blower assembly is described in U.S. Pat. No. 1,056,813 to McLean. McLean desired to use a volume blower with a large volume between a scroll wall of a blower housing and a wheel (or impeller) as a pressure blower in some instances by controlling the point of cut-off or minimum distance between the blower housing/scroll wall and periphery of the wheel. In McLean's blower assembly, a scroll cut-off is hingedly connected to the scroll wall of the blower housing allowing the scroll cut-off to pivot about a point of attachment. A horizontal portion of the scroll cut-off overlapped an airflow outlet or discharge duct of the blower assembly, and the horizontal portion generally traversed the airflow outlet. A governor was used to adjust the minimum distance between the blower housing/scroll wall and periphery of the wheel dependent upon the speed of the motor.

Another inventor determined a different way of adjusting the scroll cut-off of a blower assembly. Japanese Patent No. 2003042097A describes an adjustment to a distance or air gap between a blower housing/scroll wall and a periphery of a wheel in blower assemblies used in vehicles. The invention is designed to overcome issues involving low frequency noise created when air blown from a centrifugal fan flows backwards into the fan due to high pressure in an air conditioning duct in a foot or a defrost mode of operation. In the blower assembly, a movable nose or scroll cut-off is provided that is pulled by a cable attached to mode selection levers. The scroll cut-off translates along a scroll wall of a housing of the blower assembly. In other modes, the cable pushes the nose or scroll cut-off back along the scroll wall toward the fan to decrease the air gap in the remaining modes of operation. The patent further teaches use of linkages in place of the cable that are actuated to move the scroll cut-off dependent upon a pressure sensor positioned to sense pressure at an airflow outlet. Another discussed alternative, is to attach the scroll cut-off to the scroll wall allowing the scroll cut-off to pivot outward when pulled by the cable thereby altering the size of the air gap. This approach is similar to the McLean approach.

This document relates to a blower assembly having a scroll cut-off that is adjustable using an actuator so that a desired airflow volume can be delivered for all modes of operation in the vehicle. Advantageously, this allows for the vehicle operator to utilize the blower assembly even in the re-circulating and heater modes. Heretofore, the rate of airflow in these modes was too high resulting in an inability to warm-up the passenger compartment to a desired temperature. Even more, the present design avoids the need for cables and/or linkages between the blower assembly and dash mounted controls, and does not result in increased turbulence and noise, vibration, and harshness.

SUMMARY

In accordance with the purposes and benefits described herein, a blower assembly is provided. The blower assembly may be broadly described as comprising a housing having a scrolled wall, a motor having an output shaft extending within the housing, an impeller positioned within the housing and mounted to the output shaft for creating an airflow along an airflow path within the housing, an airflow outlet, and a scroll cut-off. The scroll cut-off is a membrane positioned between the scrolled wall and the air flow outlet, and forms a substantially continuous surface with the scrolled wall and with the airflow outlet, along the airflow path. In a first position, the membrane is substantially taut and in a second position, the membrane is relaxed. In one possible embodiment, the scroll cut-off and the impeller define an air gap having a minimum distance in the first position.

The blower assembly also includes a former for moving the membrane between the first position and the second position, and an actuator for moving the former. In another possible embodiment, the former is pressed against the membrane in the first position. In another, the former is withdrawn from pressing against the membrane in the second position.

In still another possible embodiment, the membrane is inflatable via a valve in fluid communication with the membrane. In yet another possible embodiment, the blower assembly includes a fluid source connected to the valve for inflating the membrane to the first position. In one other possible embodiment, the valve is a two-way valve allowing fluid to be removed from the membrane in the second position.

In another possible embodiment, the scroll cut-off and the impeller define an air gap having a minimum distance in the first position and a maximum distance in the second position.

In accordance with an additional aspect, a blower assembly comprises a housing having a scrolled wall, a motor having an output shaft extending within the housing, an impeller positioned within the housing and mounted to the output shaft for creating an airflow along an airflow path within the housing, an airflow outlet, and an elastic scroll cut-off positioned between the scrolled wall and the air flow outlet, defining an air gap between the elastic scroll cut-off and the impeller, and forming a substantially continuous wall with the scrolled wall and the air flow outlet.

In another possible embodiment, the blower assembly also includes a former for moving the elastic scroll cut-off between a first position, in which the elastic scroll cut-off is substantially taut, and a second position, and an actuator for moving the former. In another possible embodiment, the former is pressed against the elastic scroll cut-off in the first position. In another, the former is withdrawn from pressing against the elastic scroll cut-off in the second position.

In still another possible embodiment, the elastic scroll cut-off is inflatable. In yet another possible embodiment, the blower assembly includes at least one valve in fluid communication with the elastic scroll cut-off and a fluid source capable of inflating the elastic scroll cut-off to the first position. In another possible embodiment, at least one valve is a two-way valve allowing fluid to be removed from the elastic scroll cut-off in the second position.

In other possible embodiments, the blower assemblies described above are incorporated into a vehicle.

In accordance with another aspect, a method of changing a rate of airflow in a blower assembly is provided. The method may be broadly described as comprising the steps of: (a) creating an airflow using an impeller positioned within a housing having a scrolled wall; (b) establishing an air gap between an elastic scroll cut-off in a first position and the impeller, the air gap determining the rate of the airflow; and (c) adjusting the air gap to affect the rate of airflow by moving the elastic scroll cut-off from the first position where the elastic scroll cut-off is substantially taut to a second position wherein the elastic scroll cut-off is relaxed.

In one possible embodiment, the elastic scroll cut-off is a membrane, and the step of adjusting includes actuating a former to move said membrane between the first position and the second position.

In still another possible embodiment, the elastic scroll cut-off is inflatable, and the step of adjusting includes altering an amount of fluid in the elastic scroll cut-off.

In the following description, there are shown and described several preferred embodiments of the blower assembly and the related method. As it should be realized, the assemblies and method are capable of other, different embodiments and their several details are capable of modification in various, obvious aspects all without departing from the assemblies and method as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the blower assembly and together with the description serve to explain certain principles thereof. In the drawing figures.

Figure 3:
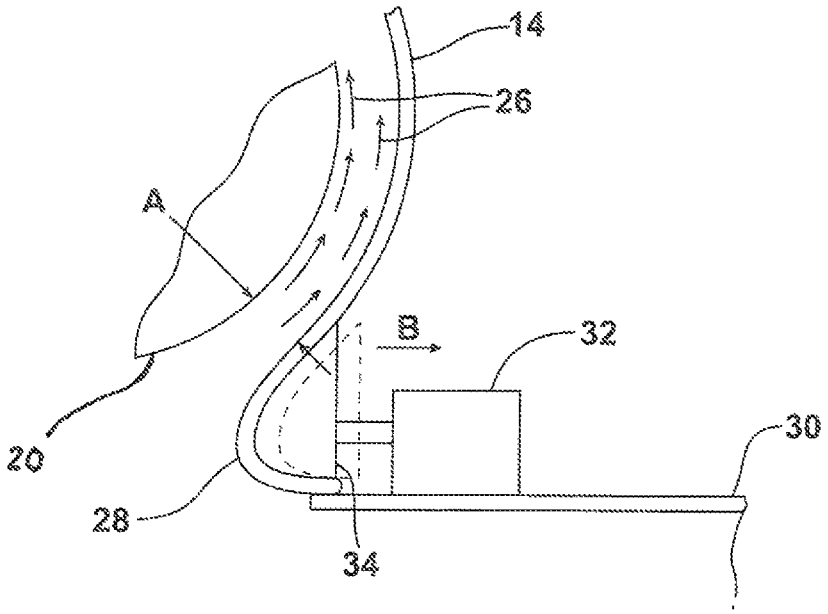
Figure 4:
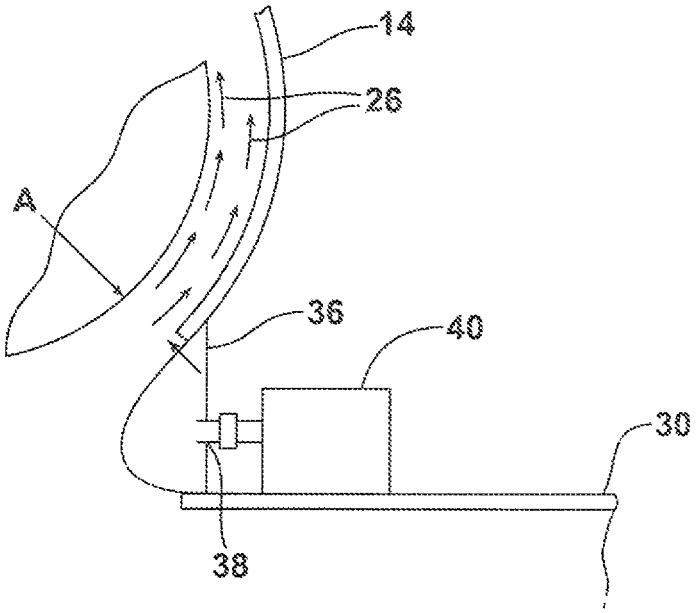

FIG. 3 is a partial cross-sectional view of the blower assembly and, in particular, an air flow within an air path and a former in contact with a membrane in a first position wherein the membrane is substantially taut and a second position wherein the membrane is relaxed; and FIG. 4 is a partial cross-sectional view of the blower assembly and, in particular, an air flow within an air path and a fluid source in communication with an inflatable membrane to inflate the membrane to a first position.

Reference will now be made in detail to the present embodiments of the blower assembly and the related method, examples of which are illustrated in the accompanying drawing figures, wherein like numerals are used to represent like elements.

DETAILED DESCRIPTION

Figure 1:
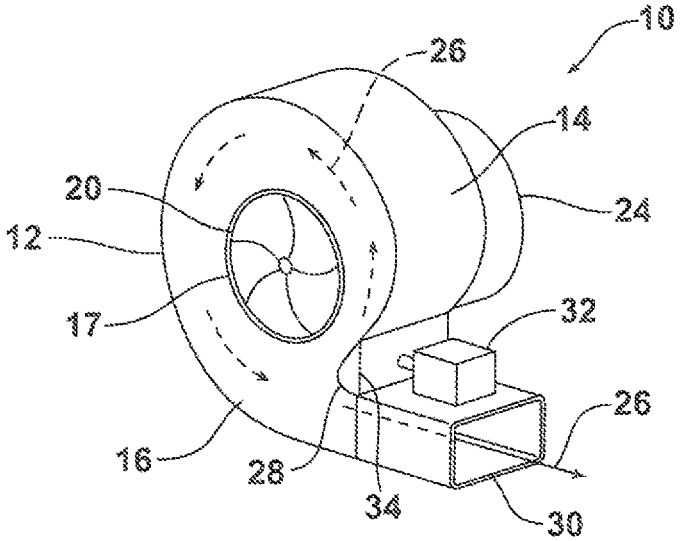
FIG. 1 is a perspective view of a blower assembly.
Figure 2:
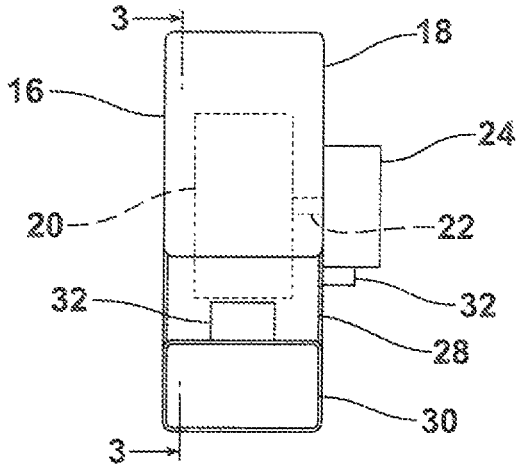
FIG. 2 is a front plan view of the blower assembly.

Reference is now made to FIGS. 1 and 2 which broadly illustrate an embodiment of a blower assembly 10 having a housing 12 including a scrolled wall 14 and side walls 16, 18. The housing is made of suitable rigid plastic materials in the present embodiment, such as, polypropylene or the like through injection, blow molding, etc. Stamped metal components could likewise be used however. An impeller 20 is positioned within the housing 12 and mounted on an output shaft 22 of a motor 24. Air is drawn into the impeller 20 through an aperture 17 in side wall 16. As shown in FIG. 2, the motor 24 in the present embodiment is mounted to the housing 12 and output shaft 22 extends into the housing where the impeller 20 is mounted. In one possible embodiment, the motor may be mounted within the housing and may even be positioned within the shaft that rotates the impeller, in order to limit the footprint of the blower assembly, as is known in the art.

In operation, motor 24 rotates output shaft 22 which in turn rotates the impeller 20 creating an airflow (generally shown by arrows 26) along an airflow path within the housing 12. The airflow 26 is generated by movement of the impeller 20 within the housing 12. The airflow 26 travels from the impeller 20 through an air gap (A) adjacent a scroll cut-off 28 within the airflow path. The airflow 26 continues around the scrolled wall 14 of the housing 12 before exiting the housing at an airflow outlet 30. The airflow outlet 30 may be attached to the housing 12, or may be integrally molded with the housing.

The scroll cut-off 28 is a membrane and is positioned between the scrolled wall and the air flow outlet. In the described embodiment, the membrane 28 is an elastomer, however, other materials such as silicone or like rubbers may be utilized for the scroll cut-off as well. A membrane is defined as any pliable sheetlike structure acting as a boundary, lining, or partition. In this instance, the membrane 28 creates a boundary between the air flow path and ambient air, and forms a substantially continuous wall with the scrolled wall 14 and the air flow outlet 30.

As shown in FIG. 3, the distance between the impeller 20 and the scroll cut-off 28 defines air gap (A) through which the airflow 26 travels. As is known in the art, that distance, or the size of the air gap (A), affects the rate of the airflow as it travels along the airflow path and exits the housing 12 at the airflow outlet 30. Altering the position of the scroll cut-off 28, or membrane in this instance, relative the impeller 20 increases or decreases the rate of the airflow 26.

In the described embodiment, an actuator 32 is a vacuum actuator and is mounted to the housing 12 in any convenient manner for moving a former 34 between a first position where the membrane is substantially taut and a second position (shown in dashed lines) wherein the membrane is relaxed. Also, the actuator 32 may be driven utilizing a vacuum source, an electrical source, a pneumatic source, or otherwise. As shown in FIG. 3, the former 34 presses against the membrane 28 in the first position causing the membrane to be substantially taut such that the air gap (A) is a minimum. In this position, the rate of air flow within the housing is a maximum.

When it is desired to lower the rate of airflow 26 from the maximum rate, without changing the speed of the motor 24/impeller 20, the actuator 32 is energized to retract the former 34 as shown by action arrow B in FIG. 3. As the actuator 32 retracts the former 34, the former is withdrawn from pressing against the membrane 28. This causes the membrane 28 to relax from the first position to the second position such that the distance between the impeller 20 and the membrane 28, i.e., the air gap (A), is increased. The rate of the airflow 26 can be controlled to a desired rate including the maximum rate when the air gap (A) is a minimum distance, in the first position, a minimum rate when the air gap (A) is a maximum distance in a second position, and any rate between the maximum and minimum, in intermediary positions.

As shown in FIG. 4, the membrane in an alternate embodiment of the blower assembly 10 is an inflatable membrane 36. The membrane 36 is inflatable via a valve 38 in fluid communication with a fluid source 40. The fluid in the described embodiment is contemplated to be air but other fluids, including gases and/or liquids, could be utilized to inflate the membrane 36. Even more, the fluid source 40 may be compressed air from the vehicle, or pressurized air. For example, the fluid may be air used in association with brake lines utilized by vehicles such as heavy trucks, or even hydraulics.

As shown, the fluid source 40 is mounted to the housing 12 in any convenient manner for inflating the membrane 36 via the valve 38 to the first position where the membrane is substantially taut such that the air gap (A) is a minimum. In this position, the rate of air flow within the housing is a maximum. In the described embodiment, a two-way valve is utilized that allows for fluid to enter and leave the membrane 36 through a single valve. Other embodiments could utilize multiple valves including a first valve in communication with the fluid source 40 and a second valve for removing fluid from within the membrane 36.

When it is desired to lower the rate of airflow 26 from the maximum rate, without changing the speed of the motor 24/impeller 20, fluid is withdrawn from the membrane 36. As the fluid is removed, the membrane 36 relaxes from the first position to the second position such that the distance between the impeller 20 and the membrane 36, i.e., the air gap (A), is increased. The rate of the airflow 26 can be controlled to a desired rate including the maximum rate when the air gap (A) is a minimum distance, in the first position, a minimum rate when the air gap (A) is a maximum distance in a second position, and any rate between the maximum and minimum, in intermediary positions.

In another aspect of the invention, a method of changing a rate of airflow in a blower assembly 10 includes the steps of creating an airflow 26 using an impeller 20 positioned within a housing 12 having a scrolled wall 14, establishing an air gap (A) between an elastic scroll cut-off 28 in a first position and the impeller, and adjusting the air gap to affect the rate of airflow by moving the elastic scroll cut-off 28 from the first position wherein the elastic scroll cut-off is substantially taut to a second position wherein the elastic scroll cut-off is relaxed.

The airflow 26 is created by driving the impeller 20 with a motor 24 such that the impeller rotates creating a flow of air within the housing 12. The rate of airflow 26 is determined by the air gap (A) which is the distance between the elastic scroll cut-off 28 and the impeller 20 in the first position shown in solid lines in FIG. 3. The air gap (A) is established in one embodiment by moving the elastic scroll cut-off 28, which in the described embodiment is a membrane, by actuating a former 34 to move the membrane 28 to a desired position between or including the first position and the second position. Once the desired position is established creating a desired rate of airflow, the air gap (A) may be further adjusted to affect the rate of airflow by energizing the actuator 32 to extend or retract the former 34.

In an alternate embodiment, the air gap (A) is established by altering an amount of fluid in the elastic scroll cut-off 28, which in the alternately described embodiment is an inflatable membrane 36. A fluid source 40 is connected to the inflatable membrane 36. The membrane 36 is inflatable via a valve 38 in fluid communication therewith. Once the desired position is established creating a desired rate of airflow, the air gap (A) may be further adjusted.

When it is desired to lower the rate of airflow 26 from the maximum rate, without changing the speed of the motor 24/impeller 20, fluid is withdrawn from the membrane 36. As the fluid is removed, the membrane 36 relaxes from the first position to a second position such that the distance between the impeller 20 and the membrane 36, i.e., the air gap (A), is increased. The rate of the airflow 26 can be controlled to a desired rate including the maximum rate when the air gap (A) is a minimum distance, in the first position, a minimum rate when the air gap (A) is a maximum distance in a second position, and any rate between the maximum and minimum, in intermediary positions.

If the air gap (A) is established at a midpoint between the first and second positions, then the fluid source 40 would lower the amount of fluid in the inflatable membrane 36 causing the membrane to further relax to the second position in order to decrease the rate of air flow by widening the air gap (A). Conversely, the fluid source 40 would increase the amount of fluid in the inflatable scroll cut-off causing the membrane to extend to the first position in order to increase the rate of air flow by lessening the air gap (A).

In summary, numerous benefits result from providing a blower assembly having a scroll cut-off that is a membrane so that a desired airflow volume can be delivered for all modes of operation in the vehicle. This allows for the vehicle operator to utilize the blower assembly even in the recirculating and heater modes. Heretofore, the rate of airflow in these modes was too high resulting in an inability to warm-up the passenger compartment to a desired temperature and known means of lowering the rate of airflow created unintended and undesired circumstances.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A blower assembly, comprising:

a housing having a scrolled wall;

a motor having an output shaft extending within said housing;

an impeller positioned within said housing and mounted to said output shaft for creating an airflow along an airflow path within said housing;

an airflow outlet; and a scroll cut-off positioned between said scrolled wall and said air flow outlet, said scroll cut-off forming a substantially continuous wall with said scrolled wall and said air flow outlet, and wherein said scroll cut-off is a membrane inflatable via a valve in fluid communication with said membrane, which membrane is substantially taut in a first position and relaxed in a second position.

2. The blower assembly of claim 1, wherein said scroll cut-off and said impeller define an air gap having a minimum distance in the first position.

3. A vehicle incorporating the blower assembly of claim 2.

4. The blower assembly of claim 1, further comprising a fluid source connected to said valve for inflating said membrane to the first position.

5. The blower assembly of claim 1, wherein said valve is a two-way valve allowing fluid to be removed from said membrane.

6. The blower assembly of claim 5, wherein said scroll cut-off and said impeller define an air gap having a minimum distance in the first position and a maximum distance in the second position.

7. The blower assembly of claim 1, further comprising a fluid source in fluid communication with said valve.

8. The blower assembly of claim 7, wherein said fluid source is mounted to said housing.

9. The blower assembly of claim 7, further comprising a second valve for removing fluid from said membrane.

10. The blower assembly of claim 7, wherein said valve is a two-way valve.

11. A blower assembly, comprising:

a housing having a scrolled wall;

a motor having an output shaft extending within said housing;

an impeller positioned within said housing and mounted to said output shaft for creating an airflow along an airflow path within said housing;

an airflow outlet; and an elastic scroll cut-off inflatable via a valve in fluid communication therewith, said elastic scroll cut-off positioned between said scrolled wall and said air flow outlet, defining an air gap between said elastic scroll cut-off and said impeller, and forming a substantially continuous wall with said scrolled wall and said air flow outlet.

12. The blower assembly of claim 11, further comprising a fluid source capable of inflating said elastic scroll cut-off to a first position.

13. The blower assembly of claim 12, wherein said valve is a two-way valve allowing fluid to be removed from said elastic scroll cut-off.

14. The blower assembly of claim 12, wherein said elastic scroll cut-off is substantially taut in the first position and relaxed in a second position.

15. The blower assembly of claim 14, further comprising a second valve for removing fluid from said membrane.

16. The blower assembly of claim 12, wherein said fluid source is mounted to said housing.

17. A method of changing a rate of airflow in a blower assembly comprising the steps of:

creating an airflow using an impeller positioned within a housing having a scrolled wall;

establishing an air gap between an elastic scroll cut-off in a first position and said impeller, said air gap determining the rate of the airflow; and adjusting the air gap to affect the rate of airflow by moving said elastic scroll cut-off from the first position wherein said elastic scroll cut-off is substantially taut to a second position wherein said elastic scroll cut-off is relaxed, wherein said elastic scroll cut-off is inflatable, and the step of adjusting includes altering an amount of fluid in said elastic scroll cut-off.

18. The method of changing a rate airflow in a blower assembly of claim 17, wherein said elastic scroll cut-off is a membrane, and the step of adjusting includes actuating a former to move said membrane between the first position and the second position.

* * * * *